US007497714B2

(12) United States Patent
Wang

(10) Patent No.: US 7,497,714 B2
(45) Date of Patent: Mar. 3, 2009

(54) ELECTRICAL CONNECTOR

(75) Inventor: Zhen-Hua Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/879,659

(22) Filed: Jul. 18, 2007

(65) Prior Publication Data

US 2008/0020622 A1 Jan. 24, 2008

(30) Foreign Application Priority Data

Jul. 18, 2006 (CN) ..... 2006 2 0075226 U

(51) Int. Cl.
*H01R 13/62* (2006.01)

(52) U.S. Cl. ..... 439/328; 439/636

(58) Field of Classification Search ..... 439/325, 439/327, 328, 636
See application file for complete search history.

(56) References Cited

U.S. PATENT DOCUMENTS

| | | | | |
|---|---|---|---|---|
| 5,567,171 | A | 10/1996 | Mizuguchi | |
| 6,726,499 | B1 * | 4/2004 | Yu | 439/328 |
| 7,048,565 | B2 * | 5/2006 | Lin | 439/326 |
| 7,198,501 | B1 * | 4/2007 | Tsai | 439/326 |

* cited by examiner

*Primary Examiner*—Tho D Ta
*Assistant Examiner*—Travis Chambers
(74) *Attorney, Agent, or Firm*—Wei Te Chung

(57) ABSTRACT

An electrical connector (3) includes an insulative housing (1) having an upper sidewall (16) and a lower sidewall (17), a slot (10) opening frontwardly defined between the upper and lower sidewalls (16, 17), the lower sidewall (17) having an arc portion (170) facing the slot (10) and concaving therefrom, and a plurality of terminals (20, 21) retained in the insulative housing (1).

9 Claims, 3 Drawing Sheets

ELECTRICAL CONNECTOR

BACKGROUND

1. Field of the Invention

The invention relates to an electrical connector, particularly to an electrical connector connecting an electronic card to a printed circuit board.

2. The Related Art

U.S. Pat. No. 6,726,499 discloses a card edge connector connecting an electronic card to a motherboard. The card edge connector comprises an insulative housing and a row of upper terminals and a row of lower terminals retained therein. The terminal has a mating portion and a mounting portion, the mating portion extending into the slot and the mounting portion extending out of the insulative housing for mounting on the motherboard, wherein the mating portions of the lower terminals are located at front of the mating portions of the upper terminals. The insulative housing has an upper sidewall, a lower sidewall, a rear sidewall, a pair of spring arms extending frontwardly from the two distal ends thereof, the rear sidewall connecting the upper sidewall and the lower sidewall together, and a slot opening frontwardly defined between upper and lower sidewalls and located between the pair of spring arms. The upper sidewall has a slant upper guiding face, and the lower sidewall has a slant lower guiding face, wherein the upper guiding face is parallel with regard to the lower guiding face. When the rear rim of the electronic card inserts into the slot, the upper and lower guiding faces guide the card inserting into the slot slantways and being at a insertion position, in this state, the card touches the lower sidewall and the rear sidewall. Then, the front rim of the card is rotated and pressed downwardly, while the rear rim of the card rotates upwardly and scrapes the rear sidewall. When the card is released from the spring arms of the connector, the mating portions of the upper and lower terminals drive the card rotating to the insertion position, the front rim of the card rotates upwardly, while the rear rim of the card rotates downwardly and scrapes the lower sidewall. Understandably, the different portions of the card will touch the upper guiding face and the lower guiding face when a driving force being perpendicular with respect to the card drives improperly the card continuing rotation, it is possible that the connector is slit into two parts if the driving force is enough. On the other hand, there are some pieces when the card scrapes the rear and lower sidewalls, and the electrical connection between the mating portions of the terminals and the card is weaken.

Therefore, it is desired to have an improved electrical connector assembly to overcome the disadvantages of the prior art.

SUMMARY OF THE INVENTION

Accordingly, an object of the present invention is to provide an electrical connector adapting to insert and release a card.

To achieve the above-mentioned object, the invention is to provide an electrical connector comprising an insulative housing having an upper sidewall and a lower sidewall, a slot opening frontwardly defined between the upper and lower sidewalls, the lower sidewall having an arc portion facing the slot and concaving therefrom, and a plurality of terminals retained in the insulative housing.

Other objects, advantages and novel features of the present invention will become more apparent from the following detailed description of the present embodiment when taken in conjunction with the accompanying drawings.

DETAILED DESCRIPTION OF THE PREFERRED EMBODIMENT

Figure 1:
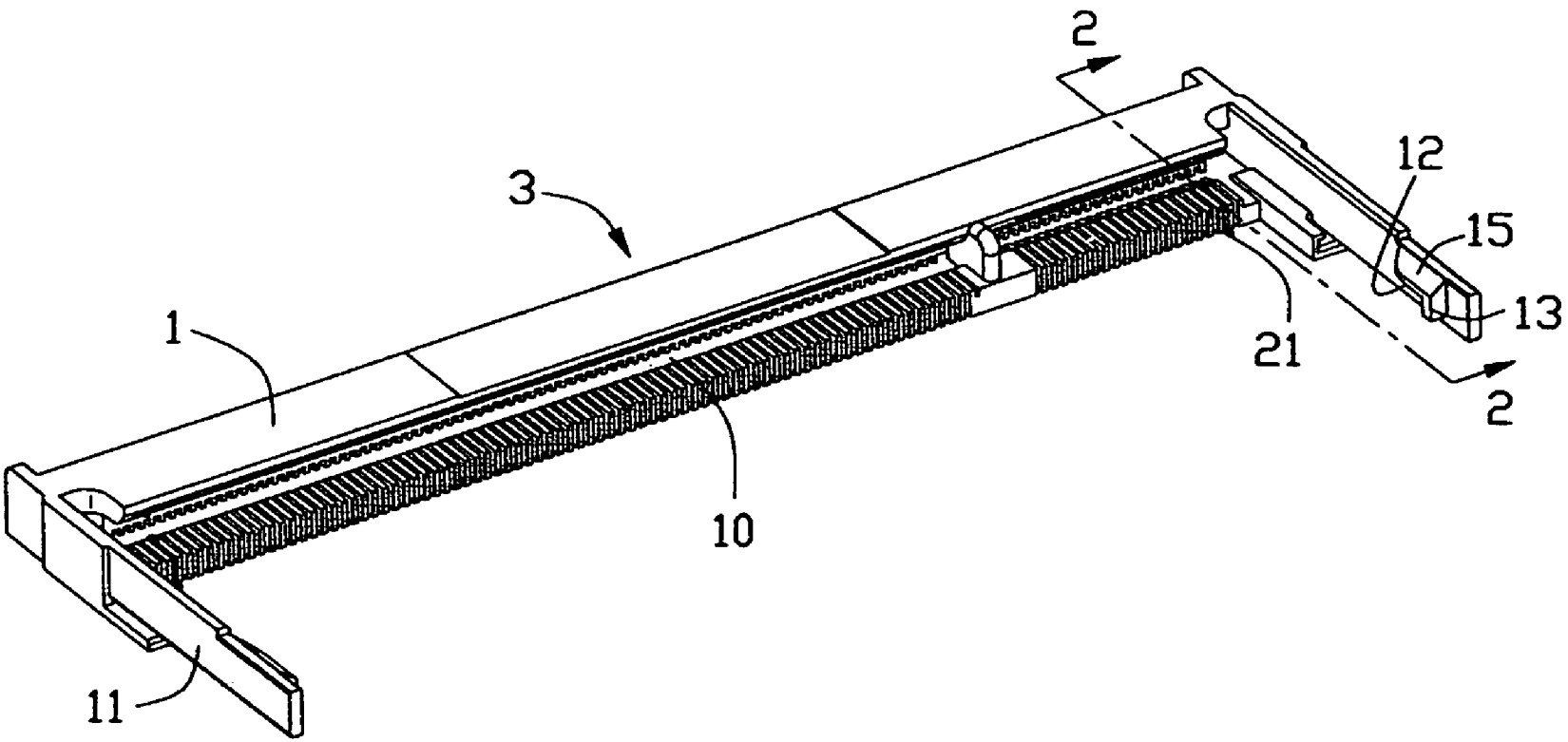
FIG. 1 is an electrical connector in accordance with a preferred embodiment of the present invention.

References will now be made to the drawing figures to describe the preferred embodiment of the present invention in detail.

It will be noted here that for a better understanding, most of like components are designated by like reference numerals throughout the various figures in the embodiments. Referring to FIG. 1, an electrical connector 3 connects an electronic card 6 to a motherboard (not shown).

Referring to FIG. 1, the electrical connector 3 has an insulative housing 1 and a plurality of upper terminals 20 and lower terminals 21 retained therein. The insulative housing 1 has an upper sidewall 16, a lower sidewall 17, a rear sidewall 18, a pair of spring arms 11 extending frontwardly from the two distal ends thereof, the rear sidewall 18 connecting the upper sidewall 16 and the lower sidewall 17 together, and a slot 10 opening frontwardly defined between upper and lower sidewalls 16, 17 and located between the pair of spring arms 11. The spring arm 11 has a latch portion 12 and a positioning portion 13 at the end thereof. The upper terminal 20 has a mating portion 200 and a mounting portion 201, the lower terminal 21 has a mating portion 210 and a mounting portion 211. The mating portions 200 of the upper terminals 20 extend into a upside of the slot 10, and the mating portions 210 of the lower terminals 21 extend into a underside of the slot 10. The mating portions 210 are located at front of the mating portions 200 of the upper terminals 20, and the mating portions 200 of the upper terminals are located at higher level than the mating portions 210 of the lower terminals. The connector 3 is positioned by the means of the posts (not shown) which extend downwardly out of the insulative housing 1 inserting into corresponding holes (not shown) of the motherboard. The card 6 inserts slantwise into the slot 10 of the connector 3 at a first position and rotates to a final position where the card 6 is parallel with regard to the motherboard, the latch portions 12 abut against the top face (not labeled) of the card 6 and keep the card 6 in a second position, and the positioning portion 13 couples in corresponding notch (not shown) of the card 6 to keep the card 6 in horizontal direction. In order to guide the card 6 rotation, the latch portion 12 has a guiding face 15 which is slant toward the card 6.

Figure 2:
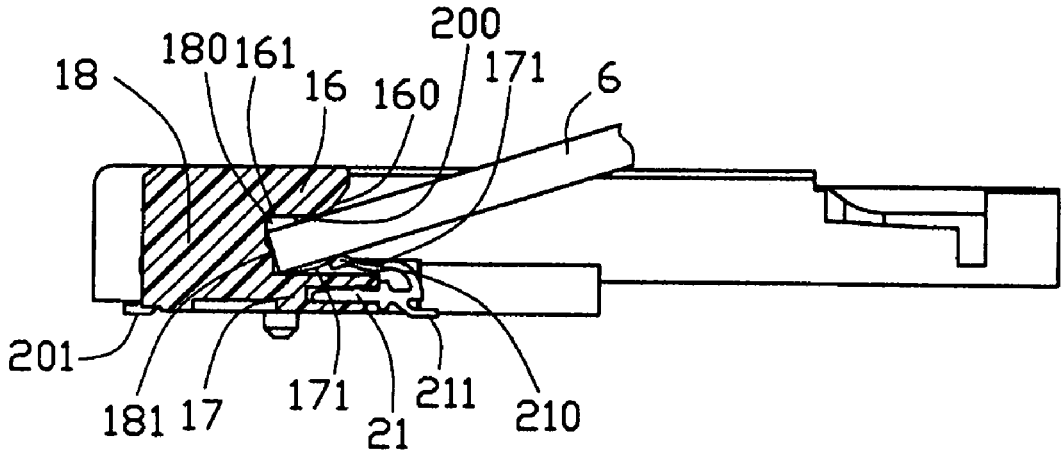
FIG. 2 is a cross-sectional view of FIG. 1 taken along line I-I while a card is at a first position.

Referring to FIG. 2, the upper sidewall 16 has a horizontal portion 161 and an arc portion 160 protruding toward the slot 10, wherein the arc portion 160 is at the front of the horizontal portion 161, and the arc portion 160 is slant in up-to-down direction and front-to-rear direction. The lower sidewall 17 has a horizontal portion 171 and an arc portion 170 concaving therefrom, wherein the horizontal portion 161 is at the front of the arc portion 160, and the arc portion 170 is slant in up-to-down direction and front-to-rear direction and joins with the rear sidewall 18. The rear sidewall 18 defines a groove 180 extending in a traverse direction and opening to the slot 10. The groove 180 is near the horizontal portion 161 of the upper sidewall 16 and forms a corner 181 protruding from the middle of the rear sidewall 18. Referring to FIG. 2, the arc portions 160, 170 guide the card 6 to the first position and insert into the slot 10, and the card 6 touches the arc portion 170 and the corner 181 at the first position. In this process, the card 6 touches the insulative housing 1 glidingly with the card 6 sliding on the arc portions 160, 170. Thus, there is not any piece scraped from the lower sidewall 17.

Figure 3:
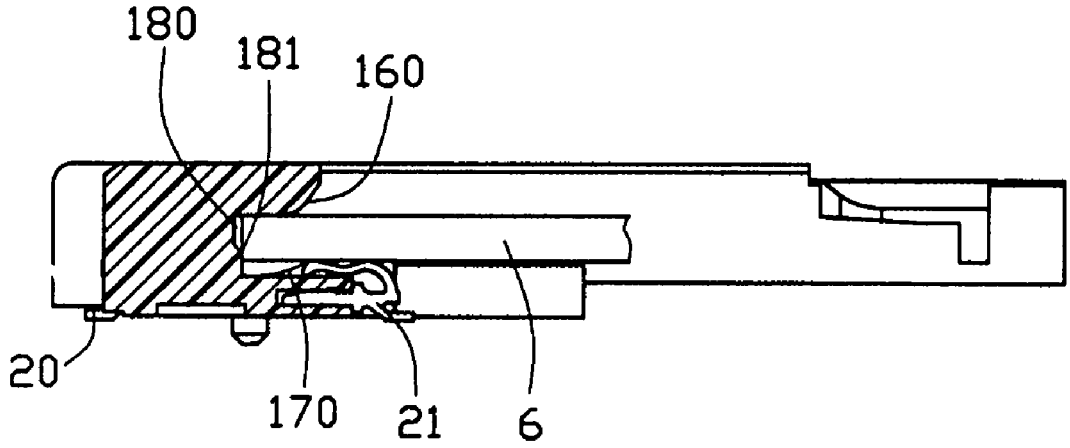
FIG. 3 is a cross-sectional view of FIG. 1 taken along line I-I while a card is at a second position.

Referring to FIG. 3, the card 6 is driven to rotate to a second position, and the card 6 rests on the lower sidewall 17 and is restricted at the second position by the latch portion 12 and the positioning portion 13. In this process, the rear rim of the card 6 touches the corner 181 and rotates in the slot 10 and the groove 180. Thus, there is not any piece scraped from the rear sidewall 18. In the process of releasing the card 6 from the connector 3, the arc portions 160, 170 of the upper and lower sidewalls 16, 17 guide the card 6 sliding glidingly thereon, so the card 6 is withdrew glidingly even though there is a driving force being perpendicular with respect to the card drives the card rotation. Understandably, the connector 3 with the arc portions 160, 170 is adaptable for receiving and releasing the card 6.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. Therefore, person of ordinary skill in this field are to understand that all such equivalent structures are to be included within the scope of the following claims.

I claim:

1. An electrical connector comprising:

an insulative housing having an upper sidewall and a lower sidewall;

a slot opening frontwardly and defined between the upper and lower sidewalls for receiving a card;

the lower sidewall having an arc portion facing the slot and concaving therefrom; and a plurality of terminals retained in the insulative housing wherein said insulative housing has a rear sidewall connecting the upper sidewall and the lower sidewall together, the rear sidewall defines a groove adjacent to the upper sidewall; wherein the rear sidewall defines a corner protruding into the slot under the groove; wherein the arc portion of the lower sidewall joins the rear wall; wherein the rear sidewall defines a corner thereon for abutting against an inner edge of the card so as the card does not scrap in the rear sidewall during rotation.

2. The electrical connector as described in claim 1, wherein the terminals have a row of upper terminals and a row of lower terminals, each upper terminal has a mating portion extending into upside of the slot and a mounting portion for mounting to a motherboard, each lower terminal has a mating portion extending into underside of the slot and a mounting portion for mounting to the motherboard.

3. The electrical connector as described in claim 1, wherein said arc portion is slant in up-to-down and front-to-rear direction.

4. The electrical connector as described in claim 3, wherein said lower sidewall has a horizontal portion, and the horizontal portion is at the front of the arc portion.

5. The electrical connector as described in claim 1, wherein the upper sidewall has another arc portion facing the slot and protruding toward the slot.

6. The electrical connector as described in claim 5, wherein said another arc portion is slant in up-to-down and front-to-rear direction.

7. The electrical connector as described in claim 6, wherein said upper sidewall has another horizontal portion, and the another arc portion is at the front of the another horizontal portion.

8. An electrical connector comprising:

an insulative housing defining a horizontal slot with upper and lower contacts by two sides thereof, said slot defining a front opening forwardly communicating with an exterior; and the slot being adapted for a card inserted into the slot from exterior at an angle in a zero insertion manner, and successively rotated to a horizontal position to mechanically and electrically engaged with the contacts; wherein the housing defines a curved front face around the front opening so as to allow the card to abut against said curved front face for obtaining a constant supporting during rotation of the card wherein the slot is successively surrounded by an upper waft, a lower wall and a rear wall connecting the upper wall and lower wall of the housing, said arc surface is concave in the lower wall and joins the rear wall; wherein the rear wall defines a corner thereon for abutting against an inner edge of the card so as the card does not scrap in the rear wall during rotation.

9. The connector as claimed in claim 8, wherein said connector further includes a latch mechanism to retain an outer edge of the card when an inner edge of the card is received in the slot.

* * * * *